US008011019B1

(12) United States Patent
Hamid et al.

(10) Patent No.: US 8,011,019 B1
(45) Date of Patent: Sep. 6, 2011

(54) INFLATABLE PROTECTIVE SUIT APPARATUS

(76) Inventors: Hassan Hamid, Dearborn, MI (US); Ahmad Hamid, Dearborn, MI (US)

( * ) Notice: Subject to any disclaimer, the term of this patent is extended or adjusted under 35 U.S.C. 154(b) by 323 days.

(21) Appl. No.: 12/400,998

(22) Filed: Mar. 10, 2009

(51) Int. Cl.
*A41D 13/00* (2006.01)

(52) U.S. Cl. ..... 2/69

(58) Field of Classification Search ..... 2/70–73, 2/102, 69, 79, 81, 93, 108, 92, 94, 44, 97, 2/312, 456, 307–310, DIG. 3
See application file for complete search history.

(56) References Cited

U.S. PATENT DOCUMENTS 1,172,615 A * 2/1916 Lelansky ..... 2/70
3,930,667 A 1/1976 Osuchowski et al.
4,059,852 A 11/1977 Crane
4,825,469 A 5/1989 Kincheloe
4,984,821 A 1/1991 Kim et al.
5,091,992 A * 3/1992 Pusic ..... 2/456
5,095,549 A * 3/1992 Aldridge ..... 2/304
D399,335 S 10/1998 Sarni, Jr.
6,088,841 A * 7/2000 Pozzer ..... 2/456
6,783,153 B2 8/2004 Mattes
7,047,567 B2 * 5/2006 Allen ..... 2/69

* cited by examiner

*Primary Examiner* — Tejash Patel
(74) *Attorney, Agent, or Firm* — Crossley Patent Law; Mark A. Crossley

(57) ABSTRACT

A inflatable protective suit apparatus provides separate upper body jacket and lower body pant with self-inflating protection. The apparatus is self-contained so that no external gas supply, electronics or other mechanisms other than the tether clip for removably clipping to an external object are needed. The tether clip can be hooked to a motorcycle, snowmobile, bicycle, AN, and any other of a host of various vehicles. Any vehicle is thereby chosen for use without regard to equipping every vehicle chosen with complimentary equipment. The apparatus places significant importance on style such that the protective mechanisms are not visually discernible.

18 Claims, 8 Drawing Sheets

INFLATABLE PROTECTIVE SUIT APPARATUS

BACKGROUND OF THE INVENTION

While airbags are now accepted in use for automobile passengers, some similar form of safety for riders of various open vehicles has become a more recognized need. Riders of motorcycles, ATV's (all terrain vehicles), snowmobiles, and bicycles are exemplary of those needing protective wear which cushions impact with extraneous objects and even the ground. Typical impact scenarios regarding such vehicles often results in a rider or riders being thrown from the vehicle.

Various devices have been proposed to mitigate injury in such circumstances. Gas tank mounted airbags, of a sort, have been offered, but these do not prevent injury to those thrown as noted. Various forms of inflating wear have been proposed. Some involve complex electronic triggering and sensing means, which is not only expensive and inherently prone to more failure than mechanical means, but also fraught with other problems. Shielding such equipment on or in open vehicles such as those named above involves complexity and cost. Equipment sending radio signals between rider and vehicle requires an almost endless multiple frequency capability in order to define one rider and vehicle from the next, as many riders travel in large groups and in close proximity. Additionally, any device which requires a permanent vehicle counterpart is flawed, as a rider must then equip any vehicle being used with that counterpart. Some devices have been proposed which are umbilicalled to a pressurized gas-providing component of a motorcycle. Serious issue arises in that high pressure, instant feed is required for the suggested devices to properly operate. If a gas shock is not fully charged or capable of providing such high, instantaneous pressure, a rider or passenger is unprotected. Further, the same vehicle dependency as noted above exists. And, without a gas-sourced vehicle, such as with many recreational vehicles and even bicycles, such an inflating suit is impossible.

Still other devices presented involve some form of lean detection, wherein a given degree of lean from vertical, for rider or machine, causes protective wear to inflate. Such devices totally negate performance riders who lean excessively, jump, flip, or perform any number of riding feats, yet these riders need protection too.

Further devices provide partial body protection, such as a vest, yet shoulders, arms, buttocks, thighs, knees, and other body parts need protection too. And, a rider of a given vehicle may need or desire only upper body or lower body protection, and a choice between those or both. Conversely, at least one previous device provided consists of a full body suit, which negates that choice.

Yet another very real concern is style. It is well established that many riders refuse to wear anything that they envision as unbecoming. Even helmets have experienced widespread rejection, even though helmets have been determined real lifesavers. Consequently, any device providing safety must seriously consider appearance.

Yet another concern is deflation of any inflating protective wear. Some devices suggest manual deflation. This is not desirable in a host of situations. For example, should an individual be injured beyond capability of operating a manual deflation mechanism, the confining and even suffocating nature of effective inflatable clothing items can be dangerous.

What has been needed is a form of protective wear which provides separate upper body and lower body self-inflating protection, a protective wear which is self-contained so that a rider may choose a vehicle without regard to equipping every vehicle chosen with complimentary equipment, one which is sufficiently stylish to encourage wear, and one which is basic and at least substantially mechanical, without complexity and electronics which increase expense and installation, and decrease reliability. The device should provide user choice in upper body protection, lower body protection, and both. Such a device should provide tethered means for triggering internally housed inflation means, as well as optional g-force auto inflation triggering. The device should also provide for self deflation, with optional time elapse choices and optional override. The present apparatus fulfills these needs.

FIELD OF THE INVENTION

The present apparatus relates to protective suits and more especially to a protective suit apparatus that is self-contained and provided in separate pants and jacket configuration.

SUMMARY OF THE INVENTION

The general purpose of the inflatable protective suit apparatus, described subsequently in greater detail, is to provide a inflatable protective suit apparatus which has many novel features that result in an improved inflatable protective suit apparatus which is not anticipated, rendered obvious, suggested, or even implied by prior art, either alone or in combination thereof.

To attain this, the inflatable protective suit apparatus provides separate upper body jacket and lower body pant with self-inflating protection. The apparatus is self-contained so that no external gas supply, electronics or other mechanisms other than the tether clip for removably clipping to an external object are needed. The tether clip would typically be hooked to a motorcycle, snowmobile, bicycle, AN, and any other of a host of various vehicles. Any vehicle is thereby chosen for use without regard to equipping every vehicle chosen with complimentary equipment. The apparatus places significant importance on style to encourage wear and to blend with other typical outerwear. Outerwear of typical appearance is defined as a jacket and pant of a style such that internally housed inflation bladders and mechanisms are not visible or obvious. The jacket and pants may be made of linen, vinyl, leather, or other appropriate materials found in use in outerwear. Typical outwear is likened to that sold for use when riding motorcycles, snowmobiles, and other vehicles, such outerwear usually sold in retail outlets, wholesale outlets, events, and catalogues, wherein safety features are not outwardly discernible.

The apparatus is basic and, with the possible exception of sensors such as the g-force sensor and the PRV/sensor, purely mechanical, without complexity and electronics which increase expense and installation, and decrease reliability. A user can wear either the jacket or the pant or both. The device provides for self deflation via each PRV/sensor. PRV/sensors are available with various time delay options for deflation action also, such that deflation of the bladders of the apparatus experience a given time delay prior to auto deflation. Additionally, auto deflation can be negated as chosen, in order to maintain inflation. This feature provides for a safety device in marine applications.

Thus has been broadly outlined the more important features of the improved inflatable protective suit apparatus so that the detailed description thereof that follows may be better understood and in order that the present contribution to the art may be better appreciated.

An object of the inflatable protective suit apparatus is to provide separate upper body and lower body protective suit segments.

Another object of the inflatable protective suit apparatus is to be self-contained, with the exception of a vehicle tether connection, so that the apparatus is not vehicle dependent.

A further object of the inflatable protective suit apparatus is to appear as typical, stylish outerwear without safety features outwardly discernible.

An added object of the inflatable protective suit apparatus is to provide mechanical inflation triggering, without the need for electronics.

And, an object of the inflatable protective suit apparatus is to provide self-contained g-force auto inflation triggering.

Further, an object of the inflatable protective suit apparatus is to be easily removed.

Yet another object of the inflatable protective suit apparatus is to provide a selectively operated automatic PRV.

An added object of the inflatable protective suit apparatus is to provide variable time delay PRV's.

These together with additional objects, features and advantages of the improved inflatable protective suit apparatus will be readily apparent to those of ordinary skill in the art upon reading the following detailed description of presently preferred, but nonetheless illustrative, embodiments of the improved inflatable protective suit apparatus when taken in conjunction with the accompanying drawings.

In this respect, before explaining the current embodiments of the improved inflatable protective suit apparatus in detail, it is to be understood that the inflatable protective suit apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved inflatable protective suit apparatus. It is therefore important that the claims be regarded as including such equivalent constructions insofar as they do not depart from the spirit and scope of the inflatable protective suit apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 8 thereof, the principles and concepts of the inflatable protective suit apparatus generally designated by the reference number 10 will be described.

Figure 7:
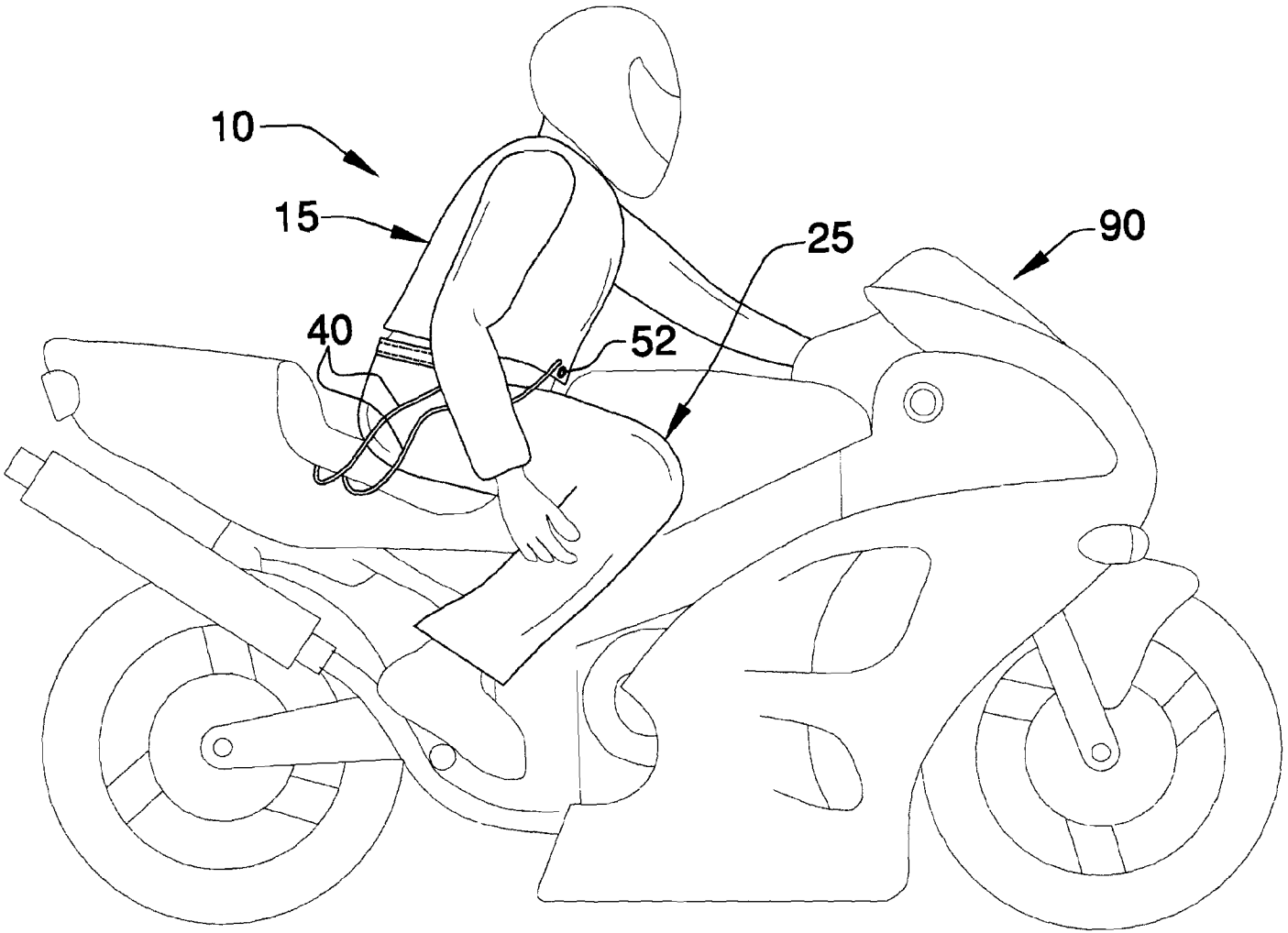
FIG. 7 is a side elevation view of the apparatus in use on a motorcycle rider, the embodiment employing the tethers for jacket and pants.
Figure 8:
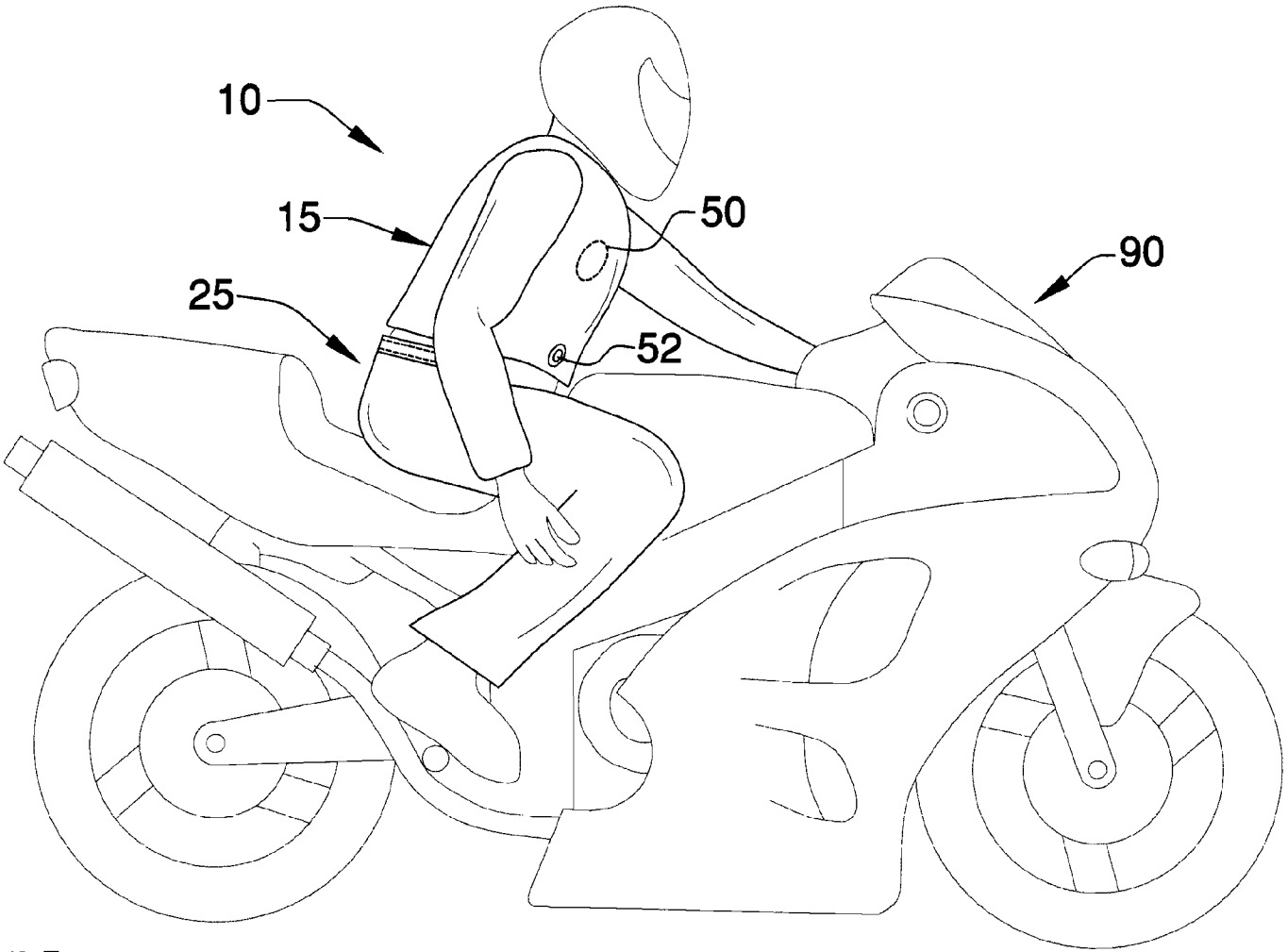
FIG. 8 is a side elevation view of the apparatus in use on a motorcycle rider, the alternate embodiment employing the g-force sensor.

Referring to FIGS. 7 and 8, the inflatable protective suit apparatus 10 is in use on a motorcycle 90 rider. The embodiment of FIG. 7 provides tethers 40 for triggering inflation of the apparatus 10. One tether 40 is in direct communication with the jacket 15. One tether 40 is in direct communication with the pant 25. When a predetermined pulling force is met, individually for each tether 40, the tether disengages from the jacket 15 or the suit 25, respectively, and activates inflation. Both the pant 25 and the jacket 15 further each comprise a PRV/sensor 52. Each PRV/sensor 52 serves dual purpose. Once impact is sensed by the PRV/sensor 52, the PRV is activated to release pressure in the jacket 15 or in the pant 25, depending upon sensing parameters of that particular PRV/sensor 52. A typical scenario for a rider of a vehicle such as the motorcycle 90 would be for the rider to be launched from the cycle 90 in a crash event. The jacket 15 or pant 25 would both have tethers 40 separated from their respective activation devices 43. Separation of a tether 40 activates filling of the associated pant 25 or jacket 15. Each PRV/sensor 52 is then primed for triggering the PRV/sensor 52 for pressure relief of the particular jacket 15 or pant 25 or both upon an impact with a ground or other external object, allowing each item to deflate separately, thereby negating after-impact bounce.

Referring to FIGS. 1-6, the jacket 15 comprises a body 23 affixed to two separate sleeves 24, a collar 21, a plurality of pockets 22, and a fastener 19 in the front 60 of the body 23. The jacket 15 further comprises an external material 20 and an interior lining 20*b*. The anterior jacket bladder 16 is disposed throughout the majority of the front 60 body 23 and sleeves 24. The anterior bladder 38 is in communication with the posterior jacket bladder 18 which is disposed throughout a majority of the rear 62 body 23 and sleeves 24. The anterior jacket bladder 16 and posterior jacket bladder 18 are defined by borders 38. The anterior jacket bladder 16 and posterior jacket bladder 18 are disposed between the interior lining 20*b* and the external material 20. The jacket 15 conforms to a typical outerwear jacket style wherein the anterior jacket bladder 16 and posterior jacket bladder 18 are not visually discernible. The jacket 15 further comprises the replaceable fill unit 64 which is in communication with either the anterior jacket bladder 16 or the posterior jacket bladder 18. The fill unit 64 is disposed between the external material 20 and the internal lining 20*b*. The fill unit 64 is comprised of the pressurized gas vessel 46 in communication with the activation device 43. Access 66 provides for insertion and removal of the fill unit 64. A tether 40 is affixed to the activation device 43, whereby a pulling pressure which detaches the tether 40 actuates the actuation device 43 in releasing the pressurized gas from the vessel 46, thereby filling the anterior jacket bladder and the posterior jacket bladder 18. A clip 42 is disposed on the tether 40 for removable attachment to an existing external object such as the motorcycle 90. An option is provided within the PRV/sensor 52 wherein a preset time delay for deflation is available. A further option comprises a means for selectively disabling the PRV/sensor 52, whereby the anterior jacket bladder 16 and the posterior jacket bladder 18 remain filled until selected otherwise.

The apparatus 10 further comprises the pant 25 having a pair of separate legs 29, a fly 32, and a waistband 30. The pant 25 further comprises, like the jacket 15, an external material 20 and an interior lining 20*b*. The anterior pant bladder 26 is disposed throughout the majority of the front 60 and is in communication with the posterior pant bladder 28 disposed throughout the majority of the rear 62. The anterior pant bladder 26 and the posterior pant bladder 28 are disposed between the interior lining 20*b* and the external material 20. The anterior pant bladder 26 and posterior pant bladder 28 are defined by borders 38. The pant 25 conforms to typical outerwear pant style wherein the anterior pant bladder 26 and the posterior pant bladder 28 are not visually discernible. The pant 25 further comprises the replaceable fill unit 64 which is in communication with either the anterior pant bladder 26 or the posterior pant bladder 28. The fill unit 64 is disposed between the external material 20 and the internal lining 20*b* and comprises the pressurized gas vessel 46 of gas in communication with the activation device 43. The access 66 is provided for the fill unit 64 replacement as needed. The tether 40 is affixed to the activation device 43, whereby tether 40 detachment actuates the actuation device 43 in releasing the pressurized gas from the vessel 46, thereby filling the anterior pant bladder 26 and the posterior plant bladder 28. A clip 42 is disposed on the tether 40 for removable attachment to an existing external object. An option is provided within the PRV/sensor 52 wherein a preset time delay for deflation is available. A further option comprises a means for selectively disabling the PRV/sensor 52, whereby the anterior pant bladder 26 and the posterior pant bladder 28 remain filled until selected otherwise.

Referring again to FIG. 8, the apparatus 10 jacket 15 and pant 25 further optionally each comprise a g-force sensor 50 in direct communication with the activation device 43. Upon sensing a predetermined g-force, the g-force sensor 50 triggers the activation device 43 to initiate release of gas from the gas vessel 46.

Figure 1:
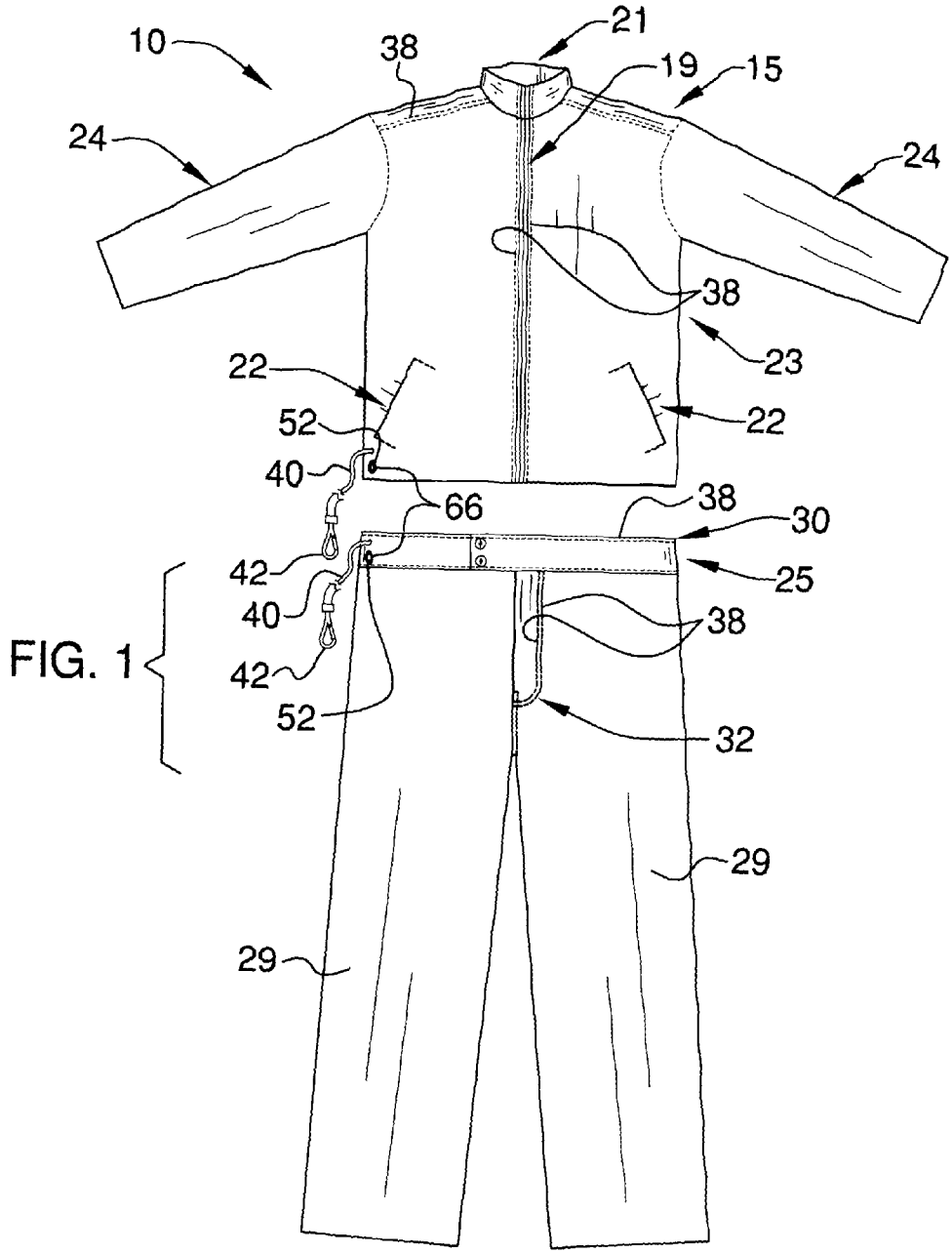
FIG. 1 is a front elevation view.
Figure 2:
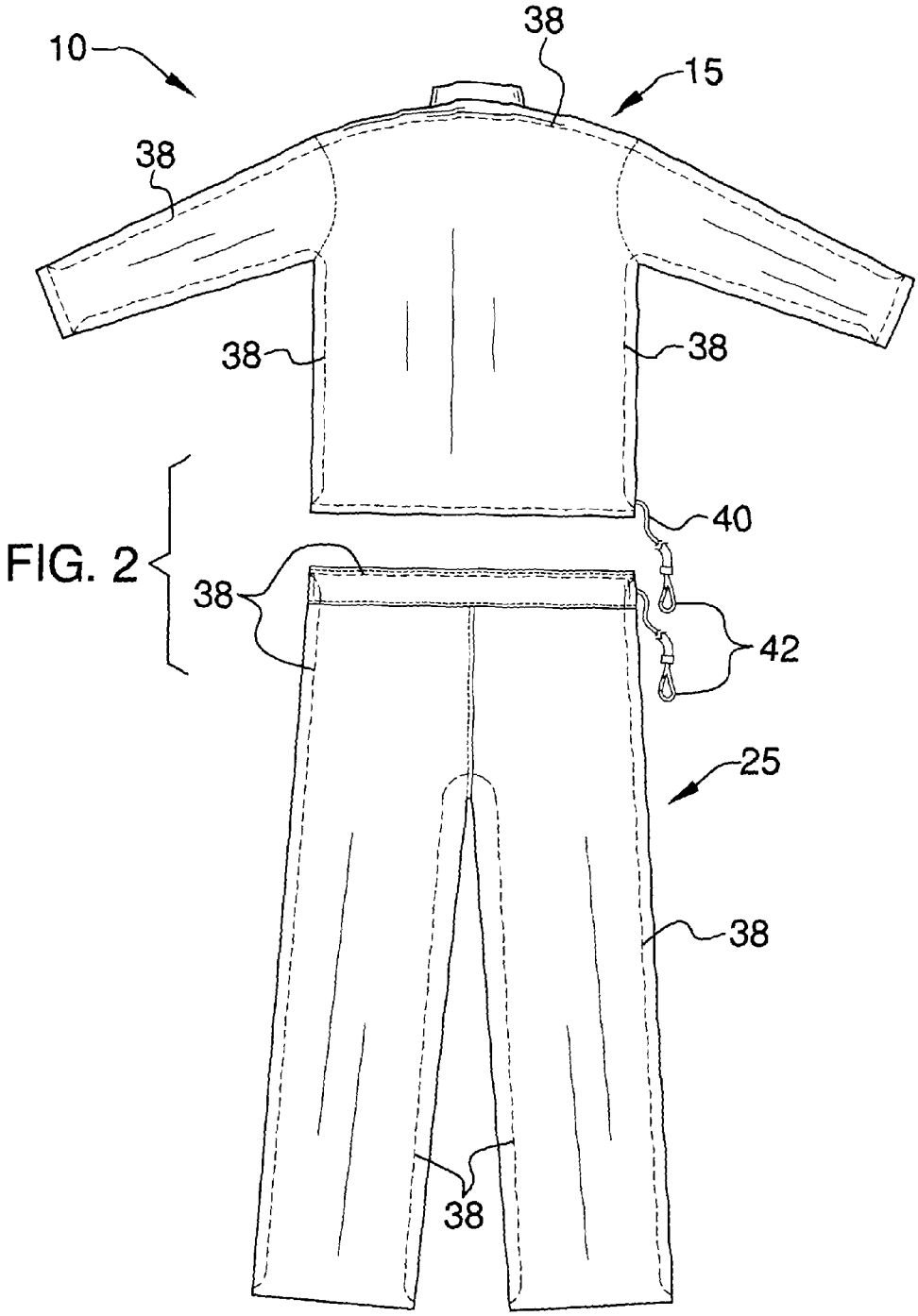
FIG. 2 is a rear elevation view.
Figure 3:
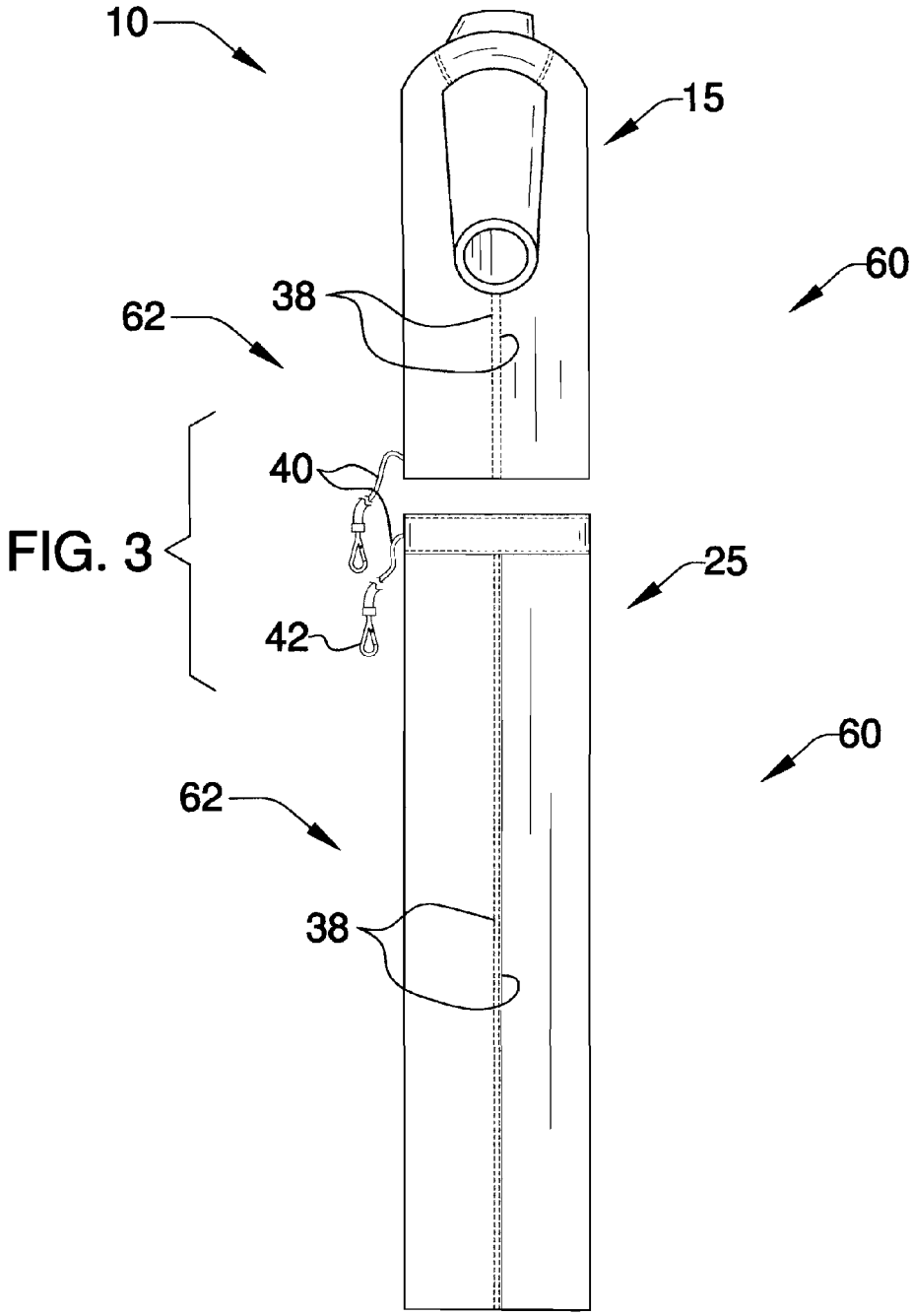
FIG. 3 is a left side elevation view.
Figure 4:
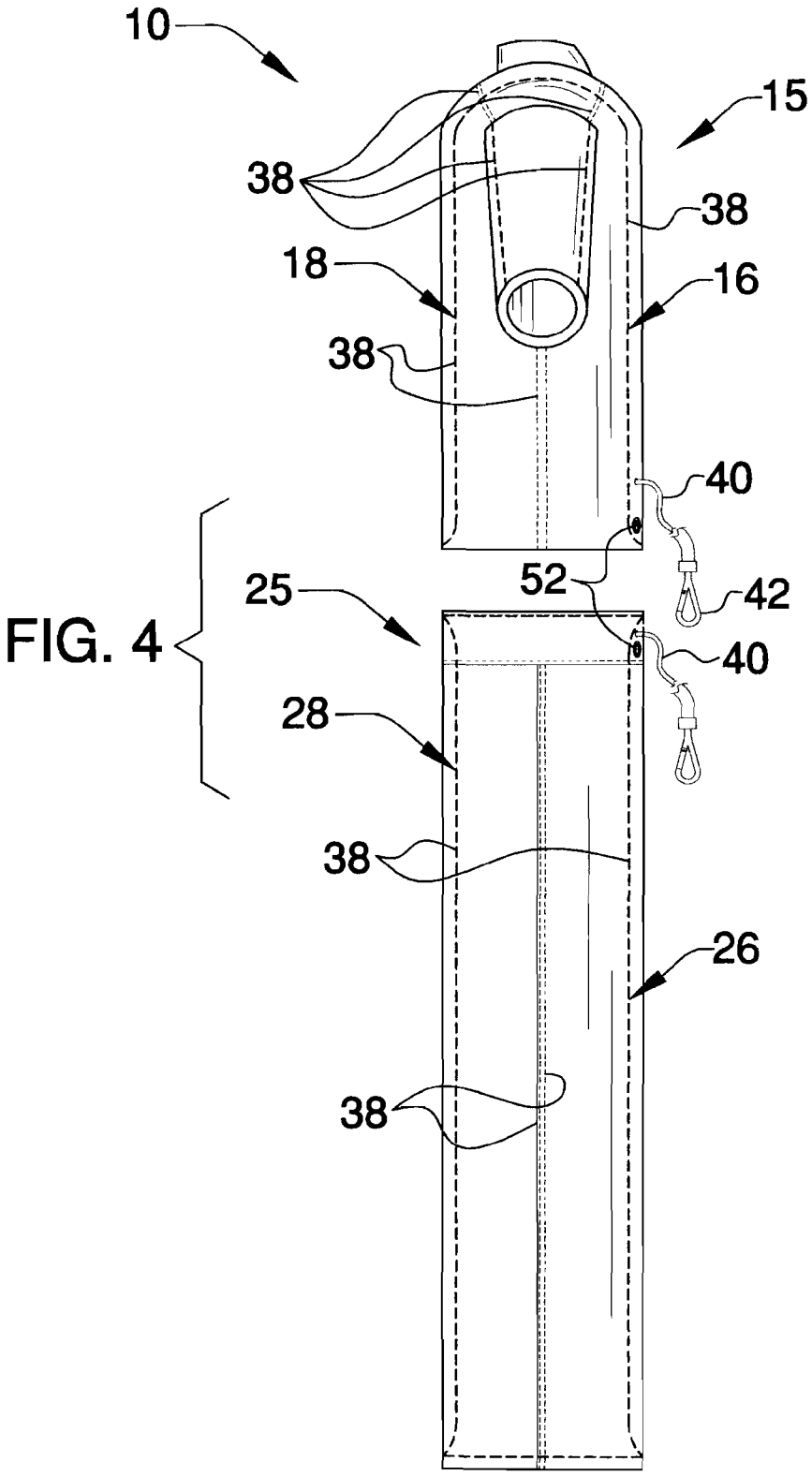
FIG. 4 is a right side elevation view.
Figure 5:
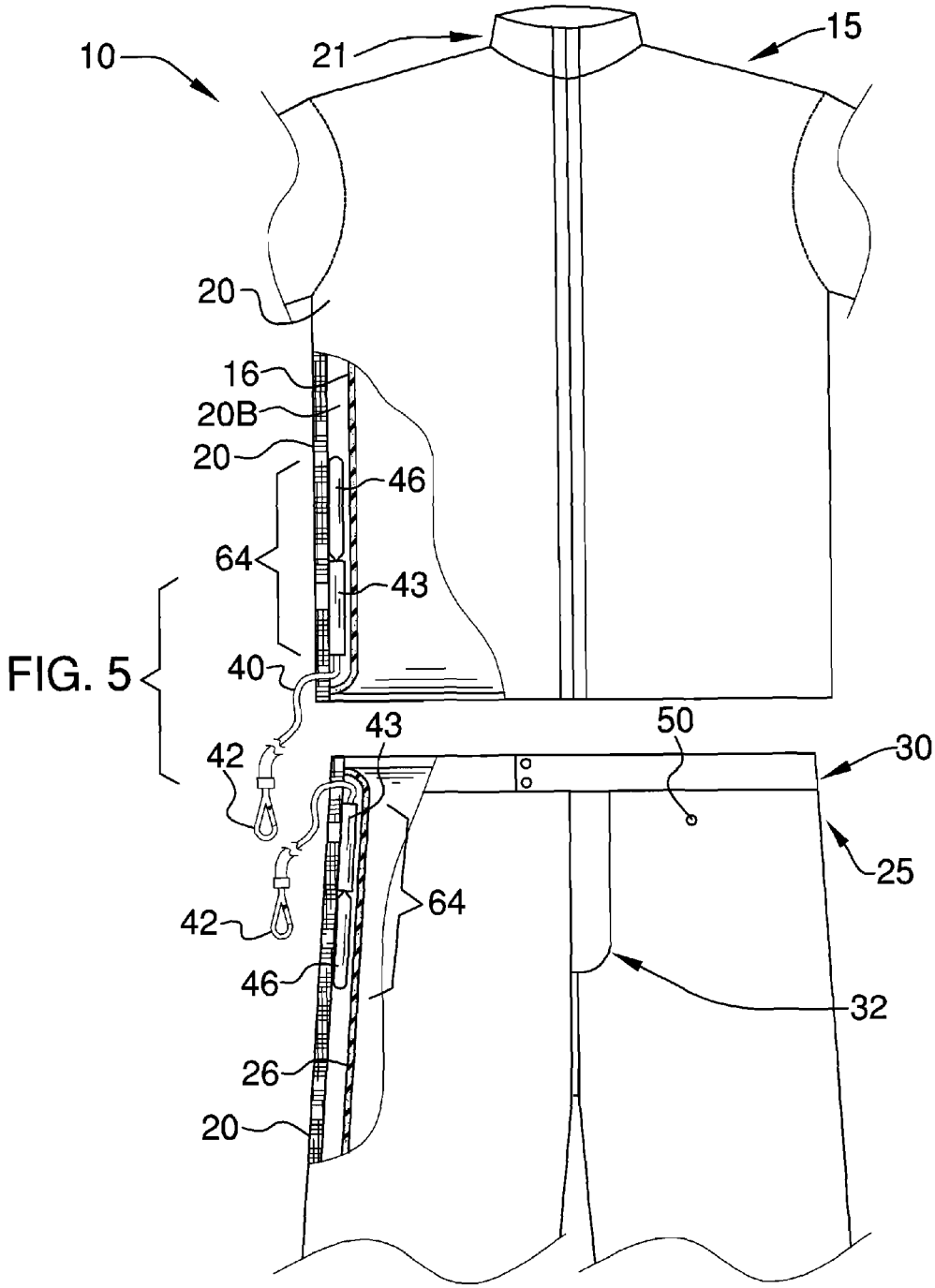
FIG. 5 is a front partial cross sectional view.
Figure 6:
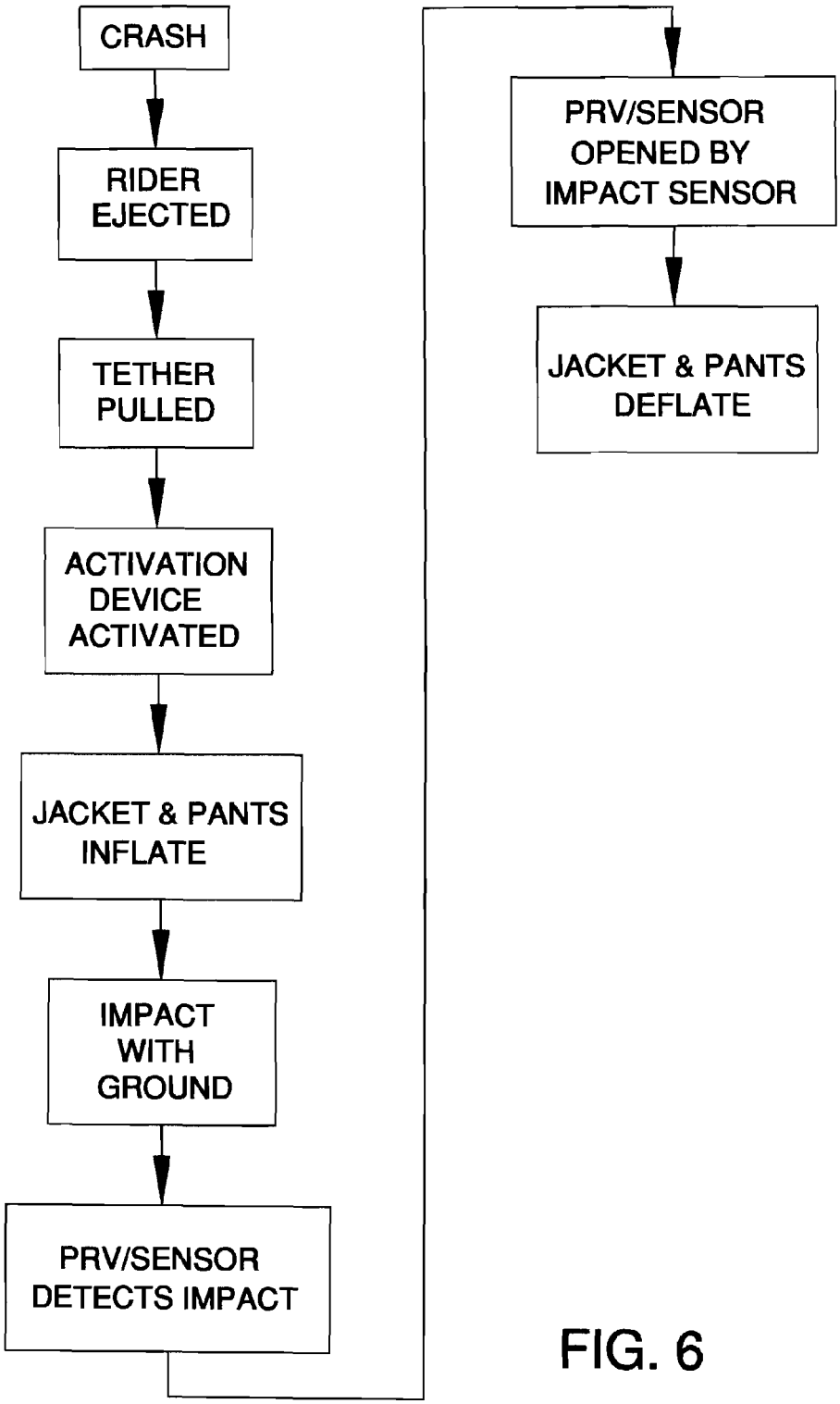
FIG. 6 is a block diagram representation of operational events of the apparatus.

In further reference to FIG. 6, a crash event occurs, whereupon a rider is ejected from the like of the motorcycle 90. Both tethers 40 are pulled, which causes each activation device 43 to trigger gas vessel 46 gas release in both pant 25 and jacket 15, whereby anterior jacket bladder 16 and posterior jacket bladder 18 are filled, and anterior pant bladder 26 and posterior pant bladder 28 are filled. Upon ground impact, PRV/sensors 52 sense impact and, within the delay framework provided, release gas from the anterior jacket bladder 16, posterior jacket bladder 18, anterior pant bladder 26, and posterior pant bladder 28. The jacket 15 and pant 25 are then deflated to a typical appearing state.

With respect to the above description then, it is to be realized that the optimum dimensional relationships for the parts of the inflatable protective suit apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the inflatable protective suit apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the inflatable protective suit apparatus may be used.

Therefore, the foregoing is considered as illustrative only of the principles of the inflatable protective suit apparatus. Further, since numerous modifications and changes will readily occur to those skilled in the art, it is not desired to limit the inflatable protective suit apparatus to the exact construction and operation shown and described, and accordingly, all suitable modifications and equivalents may be resorted to, falling within the scope of the inflatable protective suit apparatus.

What is claimed is:

1. An inflatable protective suit apparatus, comprising, in combination:

a jacket comprising a body affixed to two separate sleeves, a collar, a plurality of pockets, and a fastener, an external material and an interior lining, a jacket bladder throughout a majority of the body and sleeves, the jacket bladder disposed between the interior lining of the jacket and the external material of the jacket, wherein the jacket bladder is not visually discernible, the jacket further comprising:

a first replaceable fill unit of the jacket in communication with the jacket bladder and disposed between the external material of the jacket and the interior lining of the jacket, partially comprising a pressurized gas first vessel;

a first tether of the jacket affixed to the first replaceable fill unit of the jacket whereby a first tether detachment of the jacket actuates the first replaceable fill unit to release a pressurized gas from the first vessel, thereby filling the jacket bladder;

a first clip disposed on the first tether for removable attachment to an existing external object;

a first PRV of the jacket for deflation of the jacket bladder;

a pant having a pair of separate legs, a fly, and a waistband, an external material and an interior lining, a pant bladder throughout a majority of the pant, the pant bladder between the interior lining of the pant and the external material of the pant, wherein the pant bladder is not visually discernible, the pant further comprising:

a second fill unit of the pant in communication with the pant bladder and between the external material of the pant and the interior lining of the pant, partially comprising a pressurized gas second vessel;

a second tether of the pant affixed to the second fill unit, whereby a second tether detachment of the pant actuates the second fill unit in releasing a pressurized gas from the second vessel, thereby filling the pant bladder;

a second clip disposed on the second tether for removable attachment to an existing external object;

a second PRV/sensor of the pant for deflation of the pant bladder;

whereby the jacket and the pant are separately activated for inflation and deflation.

2. The apparatus according to claim 1 further comprising an access in the jacket and an access in the pant, thereby providing for removal and replacement of the fill units.

3. The apparatus according to claim 1 wherein each PRV/sensor further comprises a time delay.

4. The apparatus according to claim 2 wherein each PRV/sensor further comprises a time delay.

5. The apparatus according to claim 1 wherein each PRV/sensor further comprises selective operation.

6. The apparatus according to claim 2 wherein each PRV/sensor further comprises selective operation.

7. The apparatus according to claim 3 wherein each PRV/sensor further comprises selective operation.

8. The apparatus according to claim 4 wherein each PRV/sensor further comprises selective operation.

9. An inflatable protective suit apparatus, comprising, in combination:

a jacket comprising a body affixed to two separate sleeves, a collar, a plurality of pockets, and a fastener, an external material and an interior lining, an anterior jacket bladder throughout a majority of a front body and sleeves in communication with a posterior jacket bladder throughout a majority of a rear body and sleeves, the bladders disposed between the interior lining of the jacket and the external material of the jacket, wherein the anterior and posterior jacket bladders are not visually discernible, the jacket further comprising:

a first fill unit of the jacket in communication with one of the jacket bladders and disposed between the external material of the jacket and the interior lining of the jacket, partially comprising a pressurized gas first vessel of the jacket;

a first tether of the jacket affixed to the first fill unit, whereby a first tether detachment of the jacket releases a pressurized gas from the first vessel, thereby filling the jacket bladders;

a first clip disposed on the first tether for removable attachment to an existing external object;

a first PRV/sensor of the jacket for deflation of the jacket bladders;

a pant having a pair of separate legs, a fly, and a waistband, an external material of the pant and an interior lining of the pant, an anterior pant bladder throughout a majority of a front in communication with a posterior pant bladder throughout a majority of a rear, the pant bladders between the interior lining of the pant and the external material of the pant, wherein the anterior and posterior pant bladders are not visually discernible, the pant further comprising:

a second replaceable fill unit of the pant in communication with one of the pant bladders and between the external material of the pant and the interior lining of the pant, partially comprising a pressurized gas second vessel;

a second tether of the pant affixed to the second fill unit, whereby a second tether detachment of the pant releases a pressurized gas from the second vessel, thereby filling the pant bladders;

a second clip disposed on the second tether for removable attachment to an existing external object;

a second PRV/sensor of the pant for deflation of the jacket bladders;

whereby the jacket and the pant are separately activated for inflation and deflation.

10. The apparatus according to claim 9 further comprising an access in the jacket and an access in the pant, thereby providing for removal and replacement of the fill units.

11. The apparatus according to claim 9 wherein each PRV/sensor further comprises a time delay.

12. The apparatus according to claim 10 wherein each PRV/sensor further comprises a time delay.

13. The apparatus according to claim 9 wherein each PRV/sensor further comprises selective operation.

14. The apparatus according to claim 10 wherein each PRV/sensor further comprises selective operation.

15. The apparatus according to claim 11 wherein each PRV/sensor further comprises selective operation.

16. The apparatus according to claim 12 wherein each PRV/sensor further comprises selective operation.

17. An inflatable protective suit apparatus, comprising, in combination:

a jacket comprising a body affixed to two separate sleeves, a collar, a plurality of pockets, and a fastener, an external material and an interior lining, an anterior jacket bladder throughout a majority of a front body and sleeves in communication with a posterior jacket bladder throughout a majority of a rear body and sleeves, the jacket bladders disposed between the interior lining of the jacket and the external material of the jacket, wherein the anterior and posterior jacket bladders are not visually discernible, the jacket further comprising:

a first replaceable fill unit of the jacket in communication with one of the jacket bladders and disposed between the external material of the jacket and the interior lining of the jacket, comprising a pressurized gas first vessel of the jacket in communication with a first activation device of the jacket;

a first access for the first replaceable fill unit;

a first tether of the jacket affixed to the activation device, whereby a first tether detachment of the jacket actuates the first activation device to release a pressurized gas from the first vessel, thereby filling the jacket bladders;

a first clip disposed on the first tether for removable attachment to an existing external object;

a time delay first PRV/sensor of the jacket for deflation of the jacket bladders;

means for selectively disabling the first PRV/sensor;

a pant having a pair of separate legs, a fly, and a waistband, an external material and an interior lining, an anterior pant bladder throughout a majority of a front in communication with a posterior pant bladder throughout a majority of a rear, the pant bladders disposed between the interior lining of the pant and the external material of the pant, wherein the anterior and posterior pant bladders are not visually discernible, the pant further comprising:

a second replaceable fill unit of the pant in communication with one of the pant bladders and disposed between the external material of the pant and the interior lining of the pant, comprising a pressurized gas second vessel of the pant in communication with a second activation device of the pant;

a second access for the second replaceable fill unit;

a second tether of the pant affixed to an inflation device, whereby a second tether detachment actuates the second activation device to release a pressurized gas from the second vessel, thereby filling the pant bladders;

a second clip disposed on the second tether for removable attachment to an existing external object;

a time delay second PRV/sensor of the pant for deflation of the pant bladders;

means for selectively disabling the second PRV/sensor.

18. The apparatus according to claim 17 wherein the jacket and the pant each further comprises a g-force sensor for triggering each activation device.

* * * * *